US006793024B2

(12) United States Patent
Albertson et al.

(10) Patent No.: US 6,793,024 B2
(45) Date of Patent: Sep. 21, 2004

(54) ROCK DRILLING RIG

(75) Inventors: Jonas Albertson, Örebro (SE); Hans Eriksson, Värmdö (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 10/257,185

(22) PCT Filed: Apr. 12, 2001

(86) PCT No.: PCT/SE01/00820

§ 371 (c)(1),
(2), (4) Date: Oct. 9, 2002

(87) PCT Pub. No.: WO01/81706

PCT Pub. Date: Nov. 1, 2001

(65) Prior Publication Data

US 2003/0047334 A1 Mar. 13, 2003

(30) Foreign Application Priority Data

Apr. 19, 2000 (SE) ..... 0001446

(51) Int. Cl.[7] ..... E21B 7/02

(52) U.S. Cl. ..... 173/184; 173/185; 173/42; 173/193; 173/44; 182/2.9

(58) Field of Search ..... 173/184, 185, 173/44, 42, 38, 39, 190, 192, 193, 3.8; 175/220; 182/2.9, 69.4, 148

(56) References Cited

U.S. PATENT DOCUMENTS

| | | | | |
|---|---|---|---|---|
| 3,768,591 | A | * 10/1973 | Stucky et al. | 182/2.7 |
| 3,842,610 | A | * 10/1974 | Willis et al. | 405/302.1 |
| 3,967,686 | A | 7/1976 | Fagelstrom | |
| 5,632,588 | A | * 5/1997 | Crorey et al. | 198/468.2 |
| 6,378,652 | B1 | * 4/2002 | Albert | 182/69.4 |

FOREIGN PATENT DOCUMENTS

| | | |
|---|---|---|
| EP | 341918 | 11/1989 |
| SE | 358004 | 7/1973 |
| SE | 366970 | 5/1974 |

* cited by examiner

*Primary Examiner*—Scott A. Smith
(74) *Attorney, Agent, or Firm*—Mark P. Stone

(57) ABSTRACT

A rock drilling rig has a carrier (1) provided with a service platform (7) arranged on a service boom (6). The service boom has a number of relatively movable boom sections (33, 36). The service platform (7) is connected to the service boom (6) by a parallelogram mechanism (22). The service platform (7) is arranged to the side of a swing plane of the parallelogram mechanism (22) to prevent collisions between the service platform and the service boom.

1 Claim, 3 Drawing Sheets

ROCK DRILLING RIG

BACKGROUND OF THE INVENTION

The present invention relates to a rock drilling rig, more specifically to a rig provided with a service platform, a bolting aggregate or an injection device.

When driving tunnels one sometimes wants to drive the tunnel in two stages. This means that a tunnel section near the roof is situated farther forwards than the section at the floor. The difference in distance is then of the order of 3–4 m. A problem which then arises is to reach the upper tunnel front for loading of the drilled holes with explosive. A further problem consists therein that roof bolting is needed both adjacent the upper tunnel front and above the rear, lower, tunnel front. According to a prior art solution of this problem a service platform is mounted on rails which extend along the drill rig. In this way the service platform can reach the different positions where work is to be done. A drawback with this arrangement is that the operator must climb over the drill rig in order to reach the service platform. Another drawback is that the service platform and the carrying boom obscures the view for the operator when the service platform is not used during the drilling work. Furthermore the known arrangement means that the passability of the drill rig in narrow passages is deteriorated.

SUMMARY OF THE INVENTION

The present invention, which is defined in the subsequent claim, aims at achieving a drill rig by means of which one easily can load drilled holes in the upper tunnel front and perform rock bolting and/or injection work both at the upper tunnel front and above the lower, rear, tunnel front. This should be possible to do without the operator having to climb over the drill rig in order to reach the service platform. Furthermore the arrangement should allow the operator during drilling to follow the drill work without difficulty from the maneuvering place on the rig. Furthermore it should be possible to place the service platform in a position where it is not interfering during drilling and suitably placed for transport. Furthermore the maneuvering place should be capable of quick exit in an emergency situation when the service platform is used without the provision of a special emergency exit.

BRIEF DESCRIPTION OF THE DRAWINGS

An embodiment of the invention is described below with reference to the accompanying drawings in which.

DESCRIPTION OF THE BEST MODES FOR CARRYING OUT THE INVENTION

Figure 1:
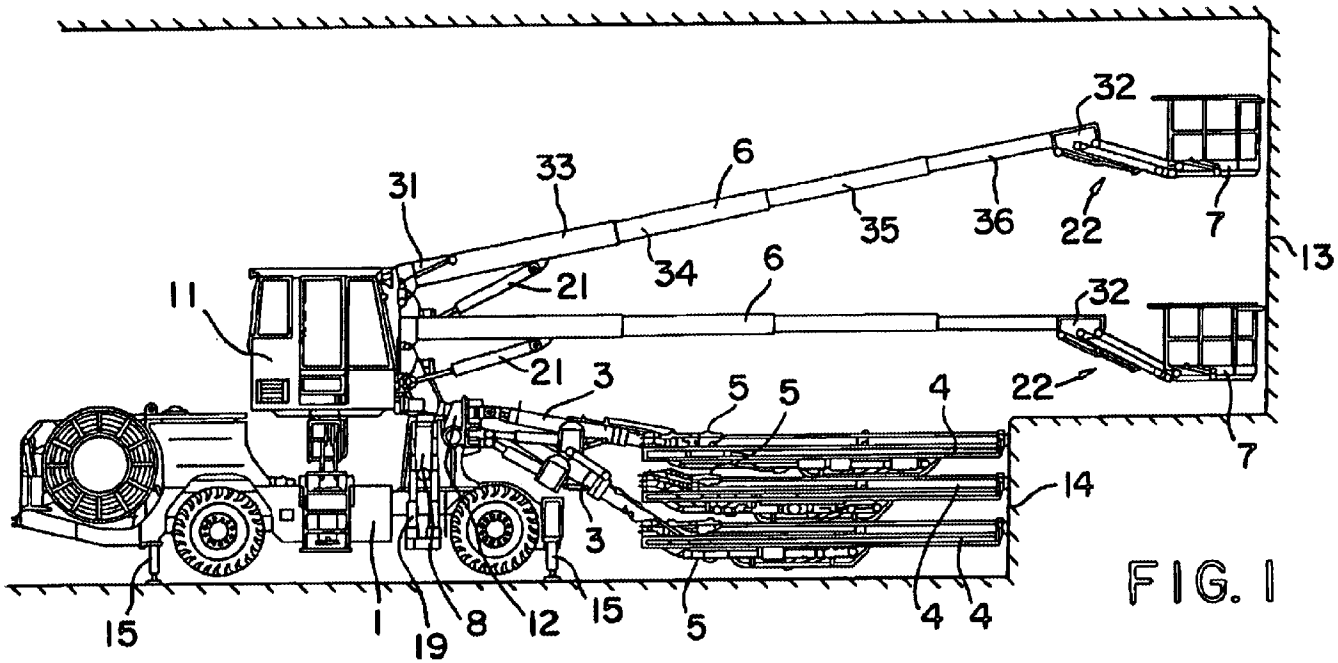
FIG. 1 shows the drill rig from the side arranged for drilling and loading of drilled holes.
Figure 2:
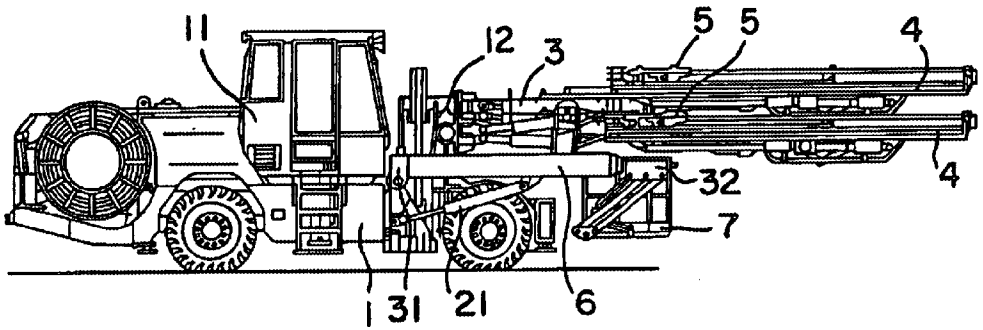
FIG. 2 shows the drill rig from the side in transport position.
Figure 4:
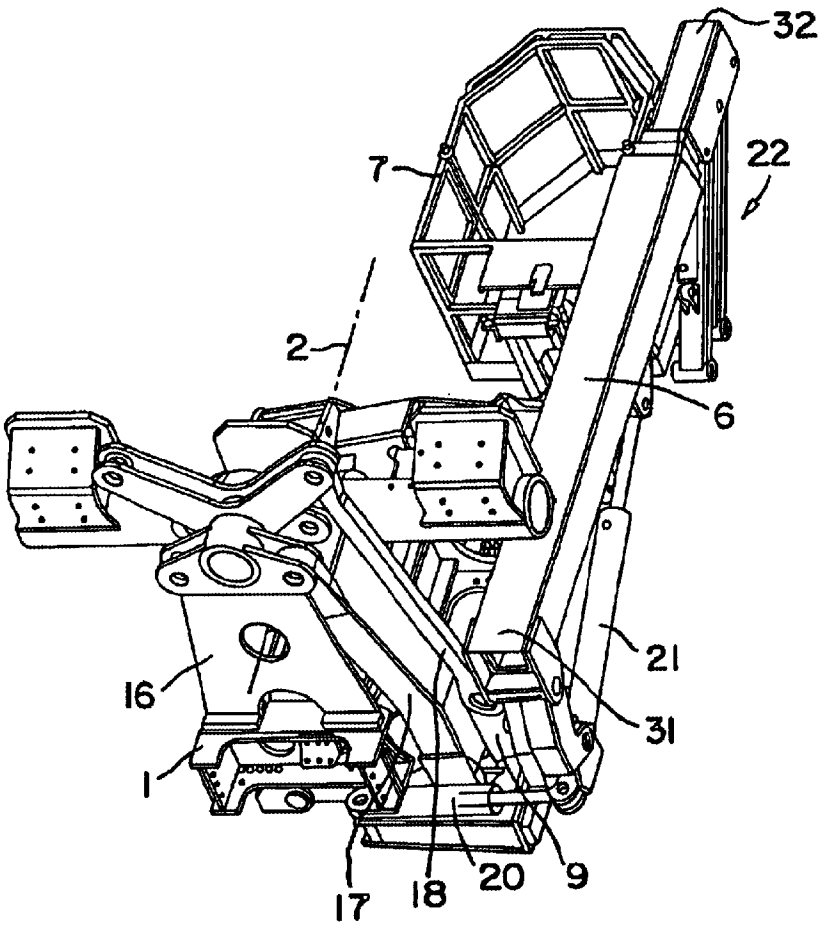
FIG. 4 shows the device according to FIG. 3 in transport position.
Figure 3:
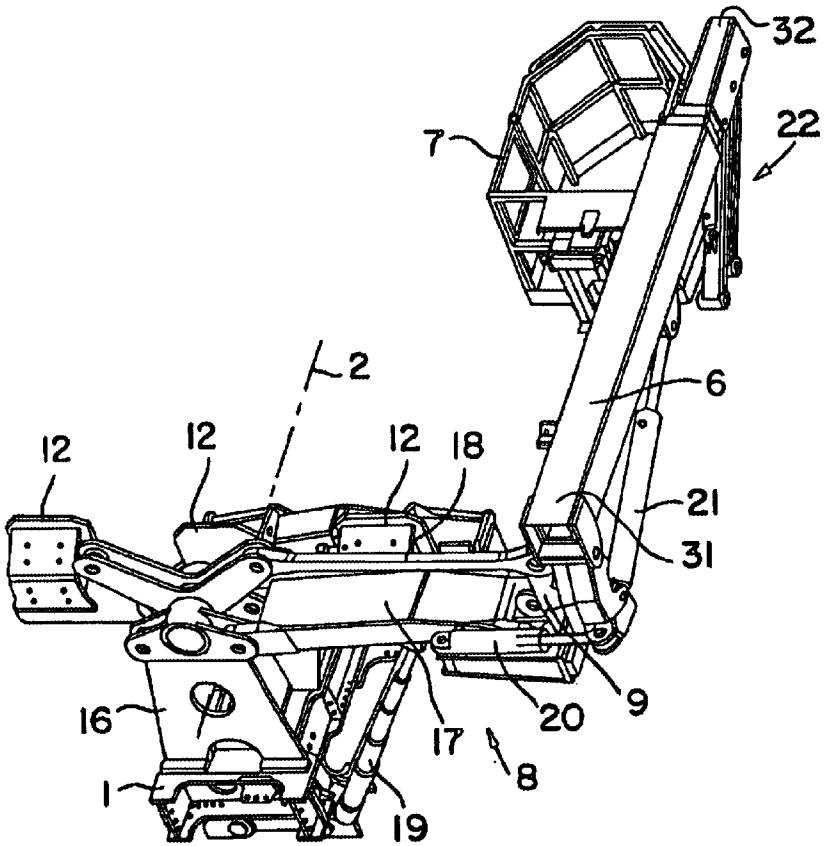
FIG. 3 shows a maneuvering device, forming part of the drill rig, for a service platform in one position.
Figure 5:
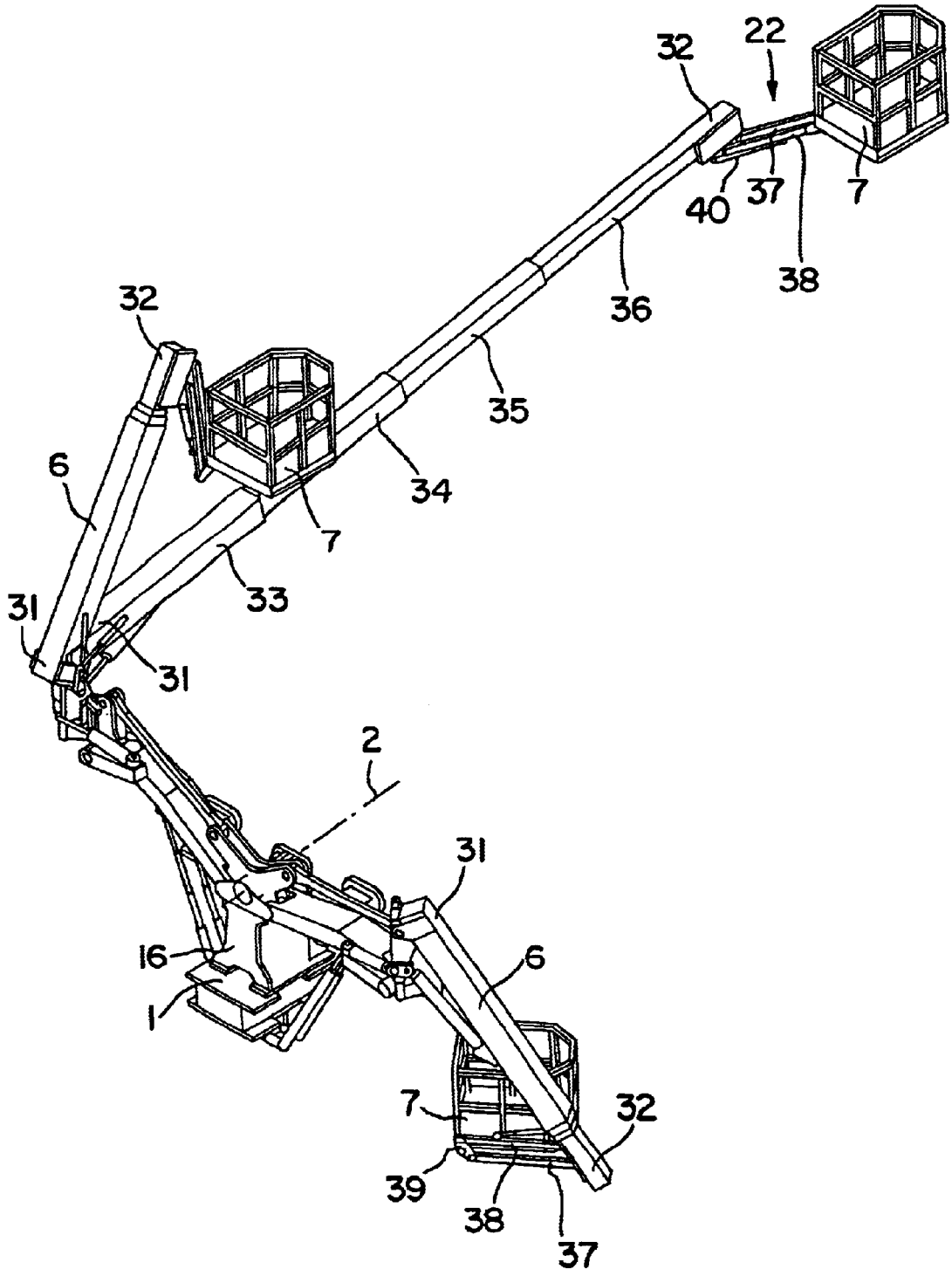
FIG. 5 shows the service boom in three different positions.

The rock drilling rig shown in the drawings comprises a carrier 1 provided with a cabin 11 being raisable and lowerable and from which an operator controls the rock drilling rig. The rock drilling rig has a longitudinal direction 2, shown in FIGS. 3 and 4. On the carrier 1 a number of brackets 12 are arranged on which drill booms 3 are arranged. On the drill booms 3 feed beams 4 are arranged along which rock drilling machines 5 are movable to-and-fro in the usual way. During work at the tunnel fronts 13 and 14 the rock drilling rig is raised on jacks 15. On the carrier 1 a support 16 for two four link mechanisms 8, one shown, is arranged. The support 16 is one of the links in the four link mechanism 8. The other links are 17 and 18 and, at a distance from the support 16, the link 9. The four link mechanism 8 is swingable in a plane which is perpendicular to the longitudinal direction 2 by means of hydraulic cylinders 19. A service boom 6, provided with a rear end 31 and a front end 32, is by means of a hydrulic cylinder 20 swingably arranged at the link 9. The booms 6 are raisable and lowerable by means of hydraulic cylinders 21. The booms 6 comprise a number of relative to each other telescopically movable boom sections 33–36. At the front end 32 of boom 6 a service platform 7 is connected by means of a parallelogram mechanism 22. The parallelogram mechanism 22 comprises two links 37 and 38 which are connected to the the front end 32 of the service boom 6 and to a bracket 39 arranged on one side of the service platform 7. The parallelogram mechanism 22 is actuated by means of a hydraulic cylinder 40. Since the swing plane of the parallelogram mechanism 22 is arranged to the side of service platform 7 the service platform can be swung to the position shown in FIG. 2 without colliding with service boom 6. With this arrangement one obtains the advantage of great range as shown in FIG. 1 at the same time as the equipment becomes compact at transport as shown in FIG. 2. Further advantages with the arrangement according to the present invention are that the service platforms can be placed behind the front jacks so that they do not interfere at drilling. Furthermore the service platforms can be raised to reach the upper tunnel front and be lowered so that it is possible to travel in low tunnels.

What is claimed is:

1. Rock drilling rig comprising a carrier (1), at least a drill boom (3) arranged on the carrier (1), a feed beam (4) arranged on the drill boom and a rock drilling machine (5) being movable to-and-fro along the feed beam, and at least a service boom (6) swingably arranged on the carrier (1) and on which a service platform (7), a bolting aggregate, or injection equipment is arranged at a front end (32) of said service boom, characterized in that the service boom (6) is provided with a plurality of boom sections (33–36) movable relative to each other, that the service platform, the bolting aggregate, or the injection equipment is connected to the service boom (6) by means of a parallelogram mechanism (22), and that the service platform (7), the bolting aggregate, or the injection equipment is arranged to a side of a swing plane of the parallelogram mechanism (22), through which collision between the service platform (7), the bolting aggregate, or the injection equipment and the service boom (6) is avoided.

* * * * *